US007395762B2

(12) United States Patent
Key

(10) Patent No.: US 7,395,762 B2
(45) Date of Patent: Jul. 8, 2008

(54) PROJECTILE FOR RAPID FIRE GUN

(76) Inventor: Mark B. Key, 6434 Harting Overlook, Indianapolis, IN (US) 44237

( * ) Notice: Subject to any disclaimer, the term of this patent is extended or adjusted under 35 U.S.C. 154(b) by 391 days.

(21) Appl. No.: 11/075,305

(22) Filed: Mar. 8, 2005

(65) Prior Publication Data

US 2006/0011088 A1 Jan. 19, 2006

Related U.S. Application Data

(63) Continuation-in-part of application No. 10/270,812, filed on Oct. 15, 2002, now Pat. No. 6,862,996.

(51) Int. Cl.
*F42B 10/00* (2006.01)
*F42B 10/32* (2006.01)
*F42B 30/02* (2006.01)

(52) U.S. Cl. ..... 102/517; 102/438; 102/439; 102/501

(58) Field of Classification Search ..... 102/293, 102/374, 376, 430–432, 438, 439, 490, 501, 102/517, 521; 244/3.3
See application file for complete search history.

(56) References Cited

U.S. PATENT DOCUMENTS

| | | | |
|---|---|---|---|
| 146,611 | A | 4/1874 | Peace et al. |
| 694,674 | A | 3/1902 | Scott |
| 1,376,538 | A | 5/1921 | Hayden |
| 2,099,993 | A | 11/1937 | Tauschek |
| 2,297,130 | A | 9/1942 | Bomar |
| 2,313,030 | A | 3/1943 | Tauschek |
| 2,377,839 | A | 6/1945 | Dake |
| 2,426,239 | A | 8/1947 | Renner |
| 2,897,757 | A | 8/1959 | Kulluck |
| 2,950,652 | A | 8/1960 | O'Brien |
| 2,967,460 | A | 1/1961 | Musser |
| 3,527,137 | A | 9/1970 | Scanlon |
| 3,618,246 | A | 11/1971 | Woodring |
| 3,712,172 | A | 1/1973 | Wiese |
| 3,745,878 | A | 7/1973 | Jampy et al. |
| 3,808,723 | A | 5/1974 | Erixon |
| 3,855,931 | A | 12/1974 | Dardick |
| 3,862,600 | A | 1/1975 | Tocco |
| 3,913,445 | A | 10/1975 | Grandy |
| 3,952,658 | A | 4/1976 | Broyles |
| 3,978,793 | A | 9/1976 | McLennan et al. |

(Continued)

FOREIGN PATENT DOCUMENTS

| | | |
|---|---|---|
| CH | 0360928 | 4/1962 |

(Continued)

OTHER PUBLICATIONS

Banks, Howeard, Madman or Genius?, Forbes Magazine, Nov. 13, 2000, pp. 244-245.

*Primary Examiner*—James S Bergin
(74) *Attorney, Agent, or Firm*—Krieg DeVault LLP

(57) ABSTRACT

An ammunition system for a rapid fire gun. The ammunition system includes a bullet having a tip that is stored in a retracted position and during flight is deployed to create an aerodynamic shape. Another aspect of the ammunition system is that the bullet has a cylindrical body having a first length in storage and a second longer length after ignition of the propellant.

16 Claims, 6 Drawing Sheets

U.S. PATENT DOCUMENTS

| | | | | | |
|---|---|---|---|---|---|
| 4,193,347 | A | | 3/1980 | Stier et al. | |
| 4,572,463 | A | | 2/1986 | Ashkenazi | |
| 4,674,706 | A | | 6/1987 | Hall | |
| 4,686,905 | A | | 8/1987 | Szabo | |
| 4,733,611 | A | | 3/1988 | Janay et al. | |
| 4,770,369 | A | | 9/1988 | Flock et al. | |
| 5,053,541 | A | | 10/1991 | Beziat et al. | |
| 5,227,577 | A | | 7/1993 | Eich et al. | |
| 5,295,439 | A | | 3/1994 | Carbone | |
| 5,329,840 | A | | 7/1994 | Corney | |
| 5,337,649 | A | | 8/1994 | Franzen et al. | |
| 5,463,957 | A | * | 11/1995 | Jensen et al. | 102/293 |
| 5,494,239 | A | * | 2/1996 | Giacomel | 244/3.1 |
| 5,608,982 | A | | 3/1997 | Bouvard et al. | |
| 5,648,637 | A | | 7/1997 | Clark, III | |
| 5,883,329 | A | | 3/1999 | O'Dwyer | |
| 6,070,352 | A | | 6/2000 | Daigle | |
| 6,123,007 | A | | 9/2000 | O'Dwyer | |
| 6,138,395 | A | | 10/2000 | O'Dwyer | |
| 6,223,642 | B1 | | 5/2001 | O'Dwyer | |
| 6,679,179 | B1 | | 1/2004 | Bohl et al. | |
| 6,727,485 | B2 | | 4/2004 | Rastegar et al. | |

FOREIGN PATENT DOCUMENTS

| | | |
|---|---|---|
| DE | 004010631 | 10/1991 |
| DE | 004101960 | 7/1992 |
| SU | 0836509 | 6/1981 |

* cited by examiner

PROJECTILE FOR RAPID FIRE GUN

CROSS-REFERENCE TO RELATED APPLICATIONS

The present application is a continuation-in-part of U.S. patent application Ser. No. 10/270,812 filed Oct. 15, 2002 now U.S. Pat. No. 6,862,996. application Ser. No. 10/270,812 is incorporated herein by reference.

BACKGROUND

The present invention relates generally to bullets/projectiles utilized in ammunition systems for rapid fire weapons. More particularly, the present invention relates to a bullet having an expanding length and/or a deployable aerodynamic tip.

Many of the multitude of prior bullet designs were brought about by a need to enhance the effectiveness of a soldier during a military conflict. Designers of modern military hardware are well aware that various forms of projectiles for use in ammunition for firearms have been proposed over the years. For example, prior designers have suggested the use of hollow or expanding diameter projectiles, which upon impact expand in diameter to cause infliction of greater damage on the target. Further, some prior designers have suggested the use of composite projectiles, which are found to be of general unitary configuration thereby adding length to the projectile. The added length was mainly to enhance long range accuracy, but upon impact with the target, the composite projectile separates into two separate relatively short projectiles. The short projectiles tend to tumble within the target thereby increasing the damage inflicted on the target.

The above brief description of prior systems reflects that weapon designers have been primarily concerned with the question as to how to inflict greater damage to the target upon impact therewith. However, these designers have not addressed the desirability of increasing the storage capacity of the weapons, nor the desirability of having bullets with expanding lengths and/or deployable aerodynamic tips to enhance flight, and/or increasing the rate of fire of the weapon. The present invention satisfies these and other needs in a novel and unobvious fashion.

SUMMARY

One form of the present invention contemplates a bullet, comprising: a body member having a first end and a second end and a cavity for a propellant therein; and, a head member coupled with the first end, the head member being moveable between a first retracted state and a second deployed state, wherein the head member being in the second deployed state during at least a portion of the bullet flight.

Another form of the present invention contemplates, a bullet, comprising: a cylindrical body having a first end and a second end with an internal propellant cavity disposed therein; a propellant located within the internal propellant cavity and adapted to discharge a gaseous flow stream from the second end; and, a tip means coupled to the first end for changing shape in response to an increase in pressure within the cavity created by ignition of the propellant.

Yet another form of the present invention contemplates, a bullet, comprising: a cylindrical body having a head end and a discharge end, the body having an internal cavity; and a propellant located within the internal cavity, wherein upon ignition of the propellant a gaseous flow stream passes from the discharge end to propel the body and expand the body from a first length to a second length, wherein the second length is greater than the first length.

Yet another form of the present invention contemplates an ammunition system comprising: a plurality of bullets, each of the bullets comprising: a cylindrical body having a first end and a second end with an internal propellant cavity disposed therein; a propellant located within the internal propellant cavity and adapted to discharge a gaseous flow stream from the second end; and a tip means coupled to the first end for changing shape in response to an increase in pressure within the cavity created by the ignition of the propellant; and the plurality of bullets are arranged in an abutting relationship, wherein the abutting relationship has a first end of one of the plurality of bullets in contact with a second end of another of the plurality of bullets, and each of the plurality of bullets are propelled independently of the others of the plurality of bullets.

One object of the present invention is to provide a unique bullet.

Related objects and advantages of the present invention will be apparent from the following description.

BRIEF DESCRIPTION OF THE DRAWINGS

FIG. 8 is an illustrative sectional view of the bullet of FIG. 6 with the tip in a deployed state.

DESCRIPTION OF THE ILLUSTRATIVE EMBODIMENTS

Figure 1:
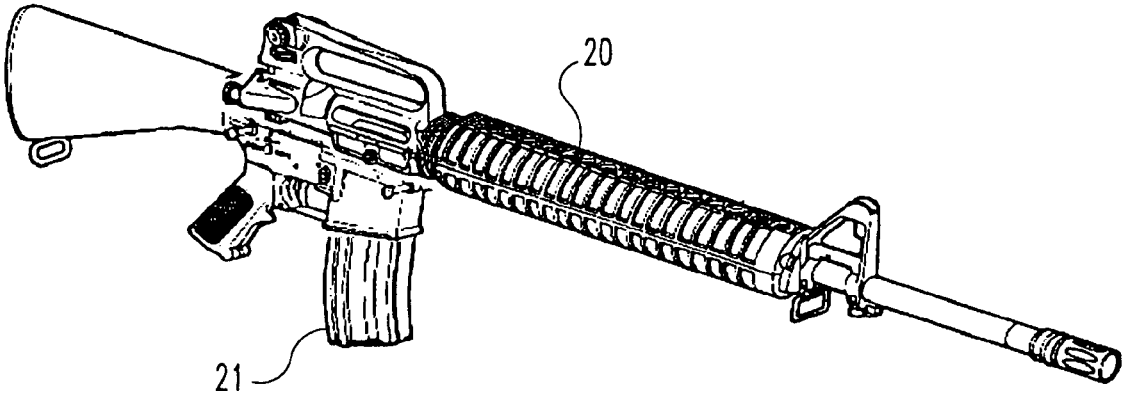
FIG. 1 is an illustrative view of one example of a rapid fire gun.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a weapon 20 having a magazine 21 coupled thereto for receiving an ammunition system. The present invention is not limited to the particular weapon 20, and is utilizable with a variety of hand-held and/or machine-mounted weaponry. One form of the present invention is utilizable with a weapon system such as a Vulcan Minigun and/or gattling gun. It is well known that a gattling-style gun separates the round loading, firing, and brass ejection into different barrel positions as they rotate. However, the present invention is not intended to be limited to any one particular type of weapons system. The description of the present invention will not focus on the weapon 20 and, instead, will describe a series of ammunition systems and bullets/projectiles that will enhance the round carrying capability of weaponry.

Figure 2:
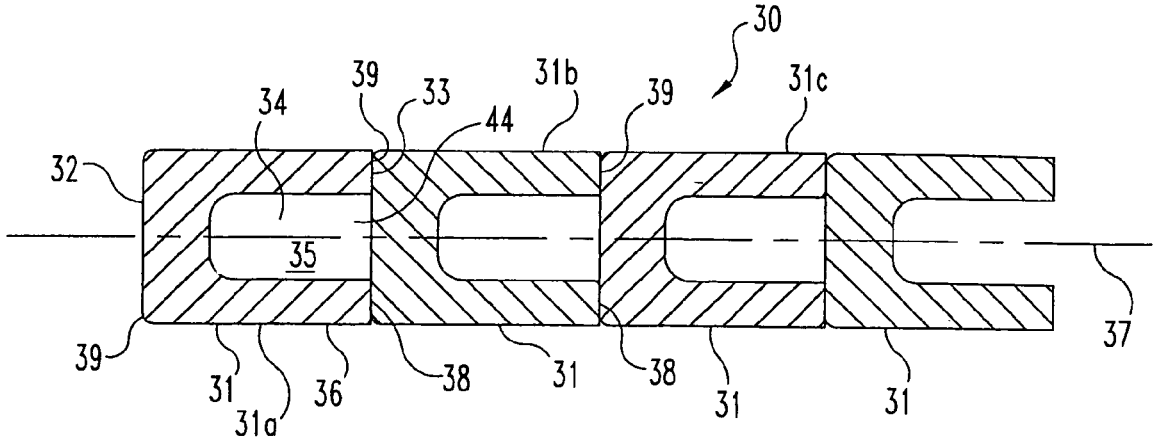
FIG. 2 is an illustrative sectional view of an ammunition system comprising a plurality of bullets of one embodiment of the present invention.

Referring to FIG. 2, there is illustrated one embodiment of an ammunition system 30. The ammunition system 30 includes a plurality of bullets/projectiles 31. The example set forth in FIG. 2 shows four bullets/projectiles 31. However, it is understood that the present invention contemplates an ammunition system that can utilize from two bullets/projectiles to practically an infinite number. Each of the bullets/projectiles 31 include a tip end 32 and a discharge end 33. An internal cavity 34 is formed within the body 36 of bullet/projectile 31 and is adapted to receive a propellant charge 35. The propellant charge 35 is located within the internal cavity 34 and in one embodiment is independently ignited for each bullet, such that a gaseous flow-stream passes through the discharge end 33 and propels the bullet/projectile 31 to the target. More specifically, the discharge end 33 includes an outlet 41 that the gaseous flow stream is discharged from. The triggering of the ammunition system 30 could be, but is not limited to: (a) pin firing; (b) electrical impulse ignition/electrical priming; (c) fuel injection/electric spark heat or flame ignition; (d) high-pressure gas propellant/injection; or (e) rail gun/magnetic propulsion. In one embodiment of the present invention, a gunpowder and mechanically operated firing pin/hammer is utilized. In another embodiment of the present invention, a solid propellant, such as gunpowder, and an electrical primer ignition is utilized.

The bullet/projectile 31 has a substantially cylindrical main body member 36 that is symmetrical about a longitudinal center line 37. The discharge end 33 includes an annular sealing surface 38 that is disposed in an abutting and sealing relationship with an outer annular surface 39 of the tip end 32 of the adjacent bullet/projectile 31. In one form of the present invention, the ignition of the propellant charge in the bullet/projectile 31*a* causes a high pressure gas to exert a force on the other bullets/projectiles 31*b* and 31*c*. The force helps maintain the annular sealing surfaces 38 and 39 in a sealing relationship for the respective non-ignited bullets/projectiles. Further, in one embodiment, the bullets/projectiles 31 are caseless rounds and therefore, the entire bullet/projectile 31 is launched from the weapon on ignition of the propellant 35. The bullet/projectile 31 may take on a variety of sizes, and shapes in one form is a blunt nose cylindrical shaped metallic casting. The bullet/projectile 31 can have any of a wide variety of lengths. However, the bullet/projectile will have a sufficient length so that when it is set in motion it does not cavitate down the barrel of the weapon system.

The present invention contemplates, in one form, that the bullet/projectiles may be coupled together, and in another form, may not be coupled together. In one embodiment, a flexible metallic membrane is utilized to couple the head portion of one bullet/projectile with the tail portion of an adjacent bullet/projectile. Upon ignition of the propellant, the connection would be dislodged/broken, and the bullet/projectile would be allowed to proceed toward the target. In another form of the present invention, an adhesive material could be utilized between the head portion of one bullet/projectile and the tail portion of an adjacent bullet/projectile. This adhesive would break under the pressure and/or heat of ignition of the propellant. In yet another form of the present invention, a metallic enriched crystalline structure is utilized as a connecting sealant/adhesive between the head portion of one bullet/projectile and the tail portion of another bullet/projectile, thereby adhering the bullets/projectiles together. This crystal adhesive/connector would be in contact with the propellant at the rear of one bullet/projectile, and when moved in position in the gun, the firing circuit would ignite the propellant. The crystal adhesive/connector would burn up, leaving substantially no material to obstruct the path of the next bullet/projectile.

Figure 3:
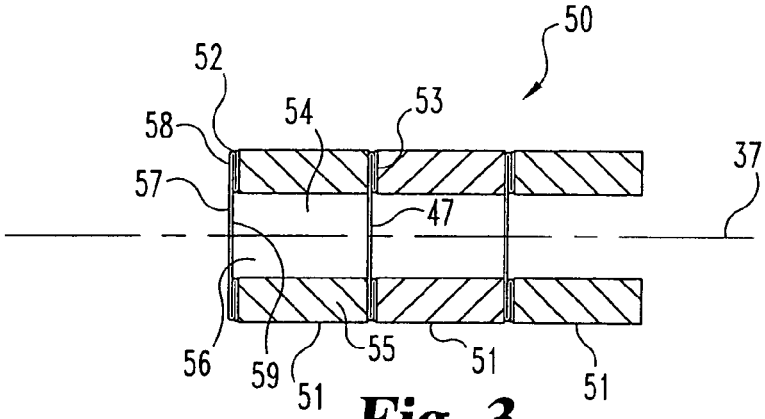
FIG. 3 is an illustrative sectional view of a plurality of bullets of one form of the present invention comprising a deployable tip portion in a retracted state.

Referring to FIG. 3, there is illustrated another ammunition system 50 of the present invention. Ammunition system 50 includes a plurality of bullets/projectiles 51 that are disposed in an abutting relationship. Each of the bullets/projectiles 51 include a tip end 52 and a discharge end 53. The bullets/projectiles 51 include an internal cavity 54 disposed within the main body 55. In a preferred form, the main body 55 is symmetrical about the longitudinal centerline 37. The internal cavity 54 holds the propellant charge 56 that is utilized to propel the bullet/projectile 51 to the target and also functions to deploy the head member 57 that is coupled to the tip end 52 of the main body member 55.

Head member 57 has a retracted position (FIG. 3) wherein its outer surface 58 is in a substantially flat or concave configuration. The concave configuration will be described below with reference to FIG. 4. Upon the ignition of the propellant 56, a gaseous flow-stream is formed in the internal cavity 54 and discharged through the discharge orifice 45 of the discharge end 53 of the bullet/projectile 51. The burning of the propellant also creates an increased pressure that bears against the inner surface 59 of the head member 57. The gas pressure exerted by the propellant within the internal cavity 54 causes the head member 57 to move from the retracted state of FIG. 3 into a deployed state. In one form the head member 57 unfolds and results in a dome-shaped configuration. An example of a deployed expanded head member is set forth with reference to the dome-shaped configuration in FIG. 5. In one form of the present invention the head member changes shape to a more aerodynamic configuration. It is understood that the present invention also contemplates other geometric configurations besides the dome-shaped configuration.

Figure 4:
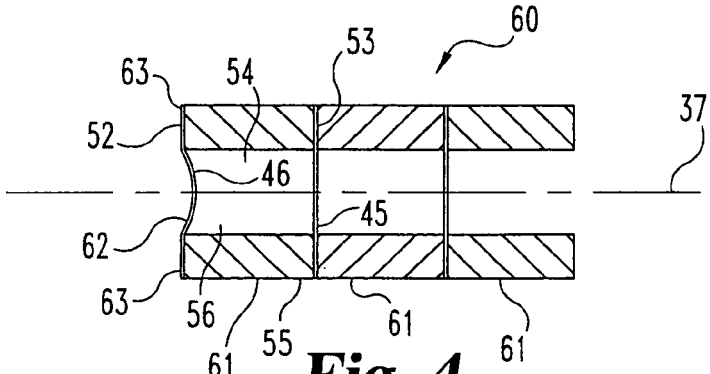
FIG. 4 is an illustrative sectional view of another embodiment of the present invention comprising a bullet with a deployable tip in a retracted state.
Figure 5:
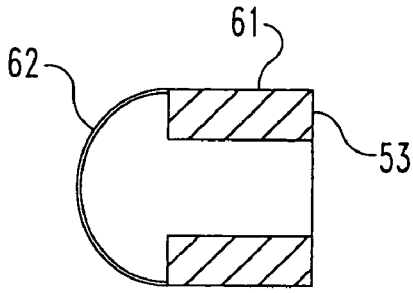
FIG. 5 is an illustrative view of the bullet of FIG. 4 in a deployed state.

With reference to FIG. 4, there is illustrated an ammunition system 60 that is substantially similar to the ammunition system 50 of FIG. 3. Like feature numbers will be utilized to represent substantially identical features in ammunition system 60. Ammunition system 60 includes a plurality of axially spaced abutting bullets/projectiles 61 that are substantially similar to the bullet/projectile 51. However, the head member 62 of bullet/projectile 61 is a reverse buckling disk. The reverse buckling disk 62 is coupled to the tip end 52 at an annular connection location 63. Upon ignition of the propellant 56 within the internal cavity 54, the gaseous flow stream exits the discharge orifice 45 of discharge end 53 to launch the bullet/projectile 61. Further, the burning of the propellant charge 56 within the internal cavity 54 causes a pressure to act on the inner surface 46 of the reverse buckling disk 62 and move it from a first retracted state to a second deployed state (FIG. 5). The drawing in FIG. 5 illustrates the head member 62 in a deployed state during travel to the target. In a deployed state, the head member 62 forms a substantially dome-shaped configuration. Further, the present invention changes the shape of the bullet tip prior to impact with the target.

In selecting the reverse buckling disk, the disk properties will be substantially determined by the bullet/projectile size and propellant required for the particular application. Reverse buckling disk technology allows for buckling at pressure as low as 1 psi to 50,000 psi and greater.

Figure 6:
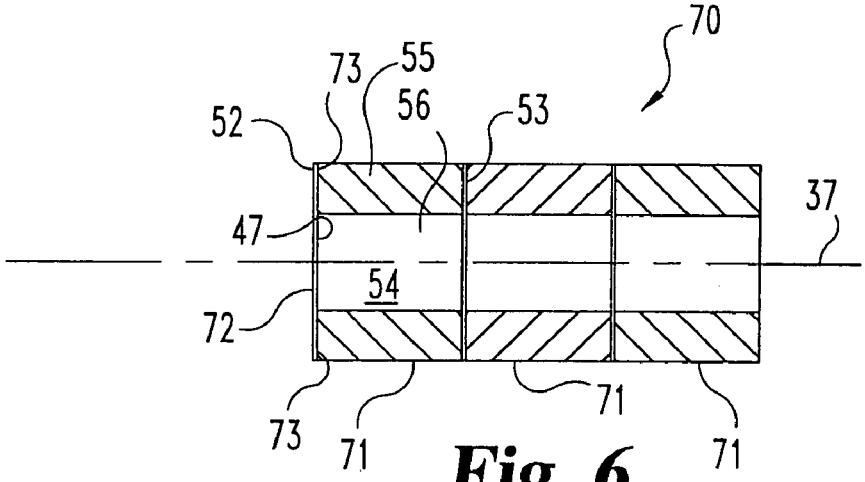
FIG. 6 is an illustrative sectional view of an alternate embodiment of the present invention comprising a bullet with a deployable tip in a retracted state.
Figure 7:
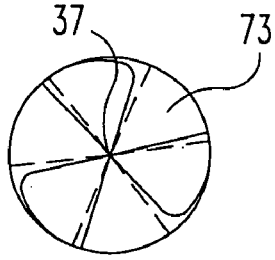
FIG. 7 is an end view of the bullet of FIG. 6 in a retracted state.

Referring to FIGS. 6 through 8, there is illustrated ammunition system 70, which is substantially similar to ammunition systems 50 and 60. The utilization of like feature numbers will be used to represent substantially similar features. Ammunition system 70 includes a plurality of bullets/projectiles 71 that are disposed in an abutting relationship and are preferably symmetrical about a longitudinal center line 37. Coupled to the tip end 52 of the projectile is a head member 72. The head member 72 is preferably coupled at an outer annular location 73 to the tip end 52 of the main body member 55. The head member 72 includes a plurality of folded/overlapping panels 73 that are moveable in response to the increase in pressure within internal cavity 54. The pressure within internal cavity 54 is increased by the ignition of the propellant 56 and bears against the inner surface 47 of the plurality of panels 73. The pressure from the burning propellant causes the unfolding/expansion of the panels 73 that are located about the longitudinal center line 37. In a preferred form the panels are metallic, however other materials are contemplated herein. The plurality of panels 73 are moved from the retracted state in FIGS. 6 and 7 to the deployed state in FIG. 8. The deployed state in FIG. 8, is an example of one geometric shape, however, other shapes are contemplated herein.

Figure 9:
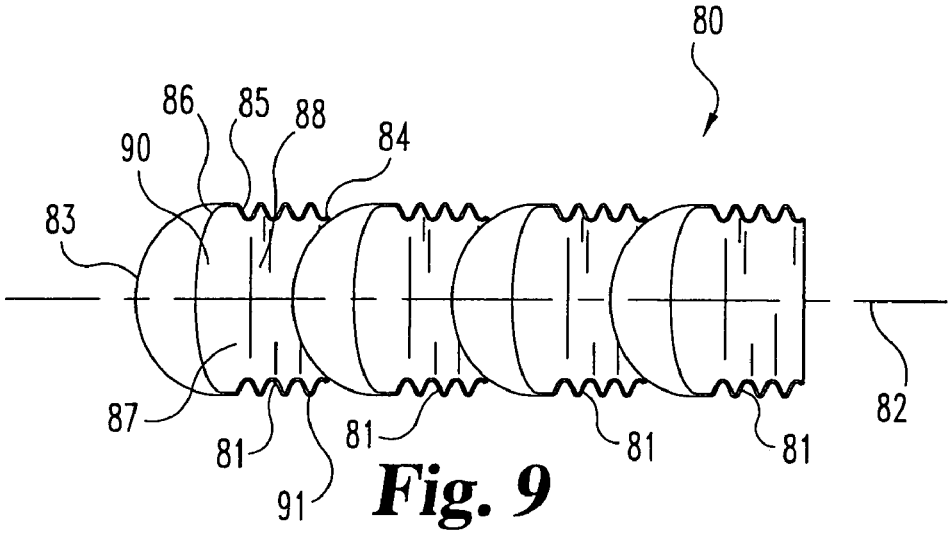
FIG. 9 is an illustrative sectional view of an ammunition system comprising a plurality of bullets having a expanding length body.
Figure 9:
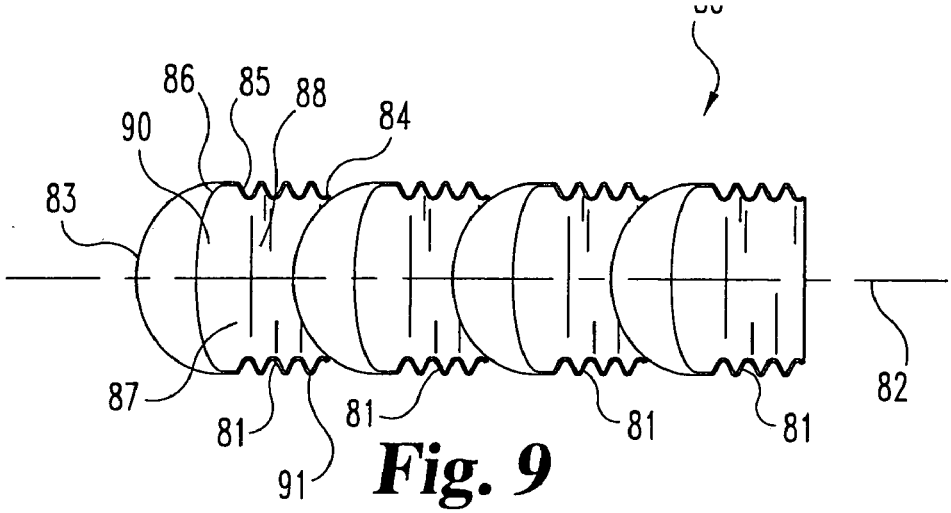
Figure 10:
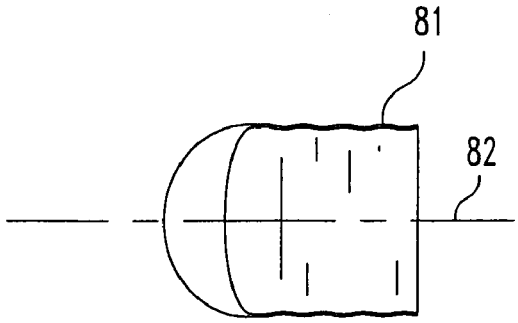
FIG. 10 is an illustrative sectional view of a bullet of FIG. 9 in an expanded state.

With reference to FIGS. 9 and 10, there is illustrated one embodiment of an alternate ammunition system 80. Ammunition system 80 includes a plurality of bullets/projectiles 81 that are disposed in an abutting relationship. In a preferred form of the present invention the bullets/projectiles 81 are symmetrical about a longitudinal center line 82. Each of the bullets/projectiles 81 includes a tip end 83, a discharge end 84, and an expandable main body member 85 that is coupled to the head 86. The main body member is expandable to increase its length in a direction substantially parallel with the longitudinal center line 82. An internal cavity 87 is formed within the bullet/projectile 81 to receive a propellant charge 88 that, upon ignition, generates a gas stream that propels the bullet/projectile 81 from the weapon and functions to cause separation from the abutting bullet/projectile 81. The pressure generated by the ignition of the propellant within the internal cavity 87 acts upon an inner surface 90 on the head 86 and causes the extension of the main body member 85 before the bullet separates from the prior bullet that it abuts.

In one form of the present invention, the main body member 85 of the bullet/projectile 81 includes an extendable portion 91. Extendable portion 91 is formed in the substantially cylindrical main body member 85. In one form of the present invention, the extendable portion 91 is defined by a plurality of axially spaced folds. The folds form a plurality of spaced pleats and in a preferred form, the extendable portion 91 is defined by an accordion folded region. The pressurized gas from the burning propellant acts on inner surface 90 to cause an unfolding of the plurality of axial spaced pleats. As the extendable portion 91 is unfolded, the length of the bullet/projectile 81 increases from a first contracted length to a second extended length, the second extended length being greater than the first contracted length.

With reference to FIG. 10, there is illustrated the bullet/projectile 81 after being separated from the other bullets/projectiles of the ammunition system 80. The main body member 85 has been substantially extended by the unfolding of the expansion portion 91. In another embodiment of the present invention there is contemplated that the bullet/projectile 81 includes a deployable tip as set forth previously with reference to the text and FIGS. 3 through 8. Thus, this alternate embodiment includes the extendable main body member set forth in FIGS. 9 and 10 and a deployable tip as set forth regarding FIGS. 3-8.

Figure 11:
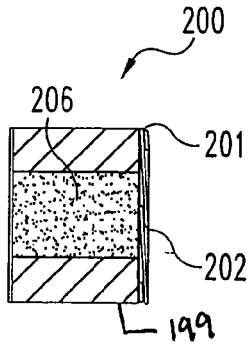
FIG. 11 is an illustrative sectional view of another bullet of the present invention in an unexpanded form.
Figure 12:
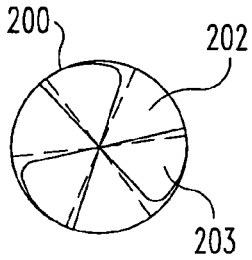
FIG. 12 is an end view of the bullet of FIG. 11 in an unexpanded form.
Figure 13:
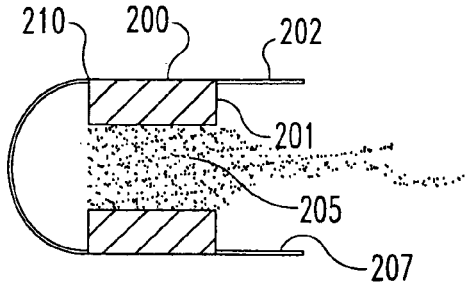
FIG. 13 is an illustrative sectional view of the bullet of FIG. 11 in an expanded form.

With reference to FIGS. 11-13, there is illustrated another embodiment of a bullet/projectile 200. A rear tail portion 202 is coupled to the end 201 of the body 199. The rear tail portion 202 includes a plurality of folding/overlapping panels 203 that are movable in response to the increase in pressure within the internal cavity 205. The pressure within the internal cavity 205 is increased by the ignition of the propellant 206 and bears against the inner surface 207 of the plurality of folding/overlapping panels 202. The pressure from the burning propellant 206 causes the unfolding/expansion of the plurality of panels 203 that are located about a centerline of the bullet/projectile 200. The plurality of panels 203 are moved from the unextended state in FIGS. 11 and 12 to the deployed state in FIG. 13. The formation of the deployed tip end 210 can be accomplished with any of the systems previously disclosed. When the propellant 206 is ignited, the rear tail portion 202 opens and expands in length.

Figure 14:
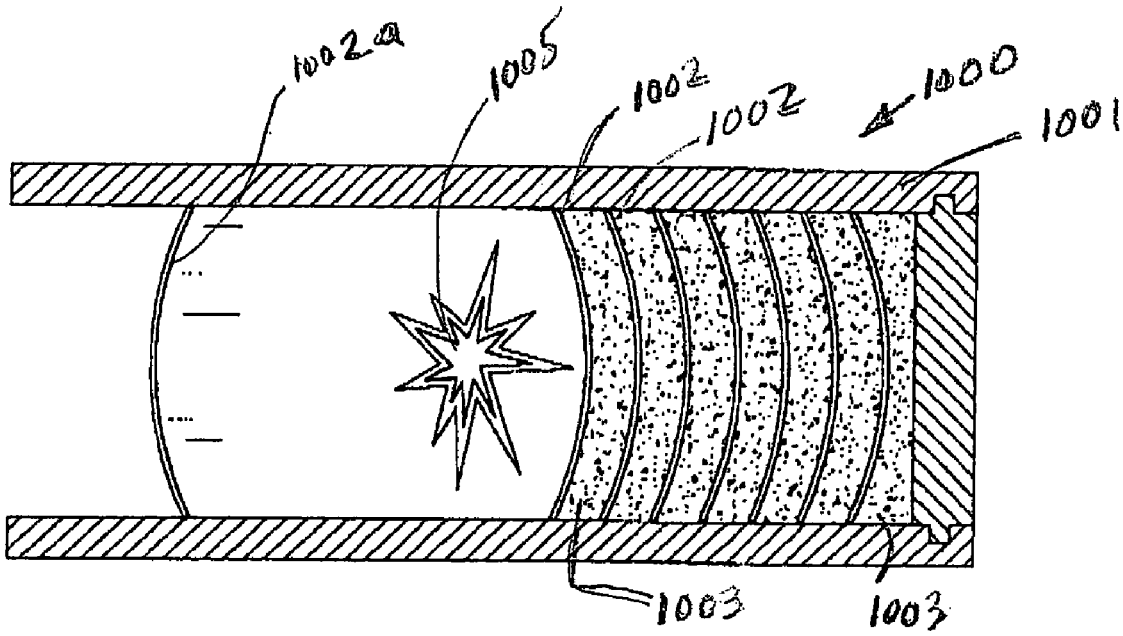
FIG. 14 is an illustrative sectional view of another embodiment of an ammunition system of the present application.

With reference to FIG. 14, there is illustrated an ammunition system 1000 located within a barrel 1001. The ammunition system includes a plurality of disks 1002 disposed within the barrel 1001. The present application contemplates that the disks 1002 may be formed in configurations including flat, reverse buckling, and/or forward concave. Preferred forms of the disk are reverse buckling/expanding members 1002 that are disposed within the barrel 1001. The disk and deployment thereof will be discussed herein with reference to the reverse buckling/expanding members 1002, however the present application is also applicable to these alternate disk forms. Reverse buckling/expanding members are available that change state when subjected to pressures as low as about one psi to those that change state when subjected to pressures as high as about 50,000 psi. A propellant charge 1003 is disposed adjacent each of the reverse buckling/expansion members 1002. Upon ignition of a respective propellant charge 1003 the burning propellant causes pressure on the inner surface of the reverse buckling/expanding member 1002 and the disk changes shape and is discharged from the barrel. In one alternate form of the present application the disk does not change shape and is discharged from the barrel.

In FIG. 14, the ignition of the propellant is illustrated by the feature 1005. The pressure from the burning propellant 1002 that was adjacent the inner surface 1002*a* causes the disk to change shape and be discharged from the barrel. In one form as the reverse buckling/expanding member 1002 changes shape it has an effective change in size therefore resulting in a decrease and/or elimination of the amount of contact with the inner surface of the barrel. In a preferred form the reverse buckling/expanding member 1002 has clearance between its outer edge and the inner surface of the barrel.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In reading the claims, it is intended that when words such as "a," "an," "at least one," or "at least a portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A bullet, comprising:

a body member having a first end and a second end and a cavity for a propellant therein;

a propellant located within said cavity and being operable for propelling said body member; and wherein said first end defining a substantially rigid head member having an outer surface which changes shape by deformation between a first state and a second state when exposed to a pressurized gas from said propellant.

2. The bullet of claim 1, wherein said head member is a reverse buckling disc that has a first side exposed to said propellant located within said cavity.

3. The bullet of claim 1, wherein said head member in said first state has one of a flat and a concave outer surface.

4. The bullet of claim 3, wherein said head member in said second state has an outer surface defining an aerodynamic shape.

5. The bullet of claim 3, wherein said head member in said second state defines a cone extending from said first end.

6. The bullet of claim 3, wherein said head member in said second state defines a dome extending from said first end.

7. The bullet of claim 1, wherein said cavity extending between said first end and said second end, and wherein said second end provides an outlet for the discharge of propellant gas, and wherein said head member has an outer surface and an inner surface, and further wherein said inner surface is exposed to the gas created by burning of a propellant within said cavity.

8. The bullet of claim 1, wherein said head member includes a plurality of outer members disposed in a folded relationship in said first state, said plurality of outer members unfold into an expanded configuration in said second state.

9. A bullet, comprising:

a cylindrical body having a first end and a second end with an internal propellant cavity disposed therein;

a propellant located within said internal propellant cavity and adapted to discharge a gaseous flow stream from said second end; and tip means coupled to said first end for changing shape in response to an increase in pressure within said cavity created by ignition of said propellant.

10. The bullet of claim 9, wherein said body is metallic and said propellant is of a powder form.

11. The bullet of claim 10, wherein said tip means changes shape from a first configuration to a second configuration before striking a target, and wherein said second configuration has a more aerodynamic shape than said first configuration.

12. The bullet of claim 10, wherein said tip means includes a plurality of overlapping metal panels that expand in response to an increased pressure within said cavity.

13. The bullet of claim 9, wherein the length of the bullet is sufficient to substantially eliminate cavitation when the bullet is in motion.

14. An ammunition system, comprising:

a plurality of bullets, each of said bullets comprising:

a cylindrical body having a first end and a second end with an internal propellant cavity disposed therein;

a propellant located within said internal propellant cavity and adapted to discharge a gaseous flow stream from said second end;

tip means coupled to said first end for changing shape in response to an increase in pressure within said cavity created by the ignition of said propellant;

wherein said plurality of bullets are arranged in an abutting relationship, said abutting relationship has a first end of one of said plurality of bullets in contact with a second end of another of said plurality of bullets, and wherein each of said plurality of bullets are propelled independent of said others of the plurality of bullets.

15. The system of claim 14, wherein said tip means changes shape from a first configuration to a second configuration before striking a target, and wherein said second configuration has a more aerodynamic shape than said first configuration.

16. The system of claim 14, wherein said tip means is fixedly coupled to said first end.

* * * * *